United States Patent [19]

Lehr et al.

[11] Patent Number: 4,872,510

[45] Date of Patent: Oct. 10, 1989

[54] SUBTERRANEAN WELL CASING FLOAT TOOL

[75] Inventors: Douglas J. Lehr, Houston; Merle L. Bell, New Waverly; Richard P. Rubbo, The Woodlands, all of Tex.; Richard L. Forehand, Ardmore Park, Singapore

[73] Assignee: Baker Hughes Incorporated, Houston, Tex.

[21] Appl. No.: 252,043

[22] Filed: Sep. 30, 1988

[51] Int. Cl.[4] ..... E21B 34/08; F16K 15/00

[52] U.S. Cl. ..... 166/327; 137/515.3; 137/515.5

[58] Field of Search ..... 166/325, 327, 328, 329, 166/143, 157; 137/515, 515.3, 515.5

[56] References Cited

U.S. PATENT DOCUMENTS

| | | | |
|---|---|---|---|
| 4,442,894 | 4/1984 | Callihan et al. | 166/328 X |
| 4,515,218 | 5/1985 | Bissonnette | 166/328 |
| 4,624,316 | 11/1986 | Baldridge et al. | 166/325 |
| 4,712,619 | 12/1987 | Stepp et al. | 166/327 |

OTHER PUBLICATIONS

The Condensed Chemical Dictionary, Eighth Edition, 1971, Van Nostrand Reinhold Co., N.Y., p. 865, Copy in Au 356.

*Primary Examiner*—Stephen J. Novosad

*Attorney, Agent, or Firm*—Hubbard, Thurman, Turner & Tucker

[57] ABSTRACT

A subterranean well casing float tool is comprised of a tubular metal housing which is securable to a well casing conduit. Varing means are implaced within the housing, with substantially all of the components of the valving means, save a biasing means, are thermosetting. The valving means has a thermosetting frame and valve head and valve seat means relative to the frame. A biasing member, such as a compressed spring is used for urging the valve head toward the valve seat to a closed position. A compartment including the valve head is provided for enclosure around the biasing means when the valve head is moved fully away from the valve seat to protect the spring from errosive turbulent fluid flow when the valve head is in the open position relative to the seat. The valving means is directly secured to the housing by means of thread members having profiled shear surfaces such that the shear area of the valving means is substantially greater than that of the metal housing.

11 Claims, 2 Drawing Sheets

SUBTERRANEAN WELL CASING FLOAT TOOL

BACKGROUND OF THE INVENTION

1. FIELD OF THE INVENTION

The present invention is directed to a subterranean well casing float tool, which may be either a float collar or float shoe, for use in a subterranean well for floating of casing and cementing operations.

2. BRIEF DESCRIPTION OF THE PRIOR ART

Subsequent to the drilling of a subterranean oil or gas well, casing is run into the well and secured to the borehole by a cementing operation which comprises introducing under pressure through the interior of the casing conduit or string a cementitious material which is pumped through the casing and out through its lower end, thence through an annular area defined by the borehole or wall and the outer diameter of the casing to stabilize the borehole, anchor the casing into the well and to isolate various geological formations or zones from one another within the well to prevent the production of water or other fluids with the desired hydrocarbons in the particular production or pay zone. In the running of the casing string into the well and during the cementing operation, there is need to provide a valving system within a collar positioned along the length of the casing or within a shoe, positioned at the lowermost end of the casing string.

During the lowering of the casing into the well, a float shoe is frequently positioned on the bottom of the casing conduit which is being lowered into the wellbore. The shoe has an end portion which is rounded and heretofore has been filled with cementitious material having a longitudinal passage therethrough within which there is positioned valving means for selectively opening and closing a flow path through the cementitious material and the valve structure as well as the casing conduit. The valve structure closes in an upward direction and opens in a downward direction. Accordingly, when the casing conduit is being lowered into the subterranean well, the valving structure is closed and the conduit is kept free of fluid, thus providing the buoyancy for flotation of the casing into the position for the cementing operation.

When the casing has been lowered into position whereby the lowermost end of the string is adjacent the lowermost end of the zone to be produced, or the like, the cement which is used for cementing the wellbore can be introduced through the casing for passage downwardly through the valving structure and out around the exterior of the lowermost end of the casing, thence upwardly to fill the wellbore around the exterior of the casing.

Float collars are sometimes utilized, either alone or in combination with the float shoe, for providing additional buoyancy. A float collar differs from a float shoe in that it has threaded connections on both ends for connection on one side to a casing conduit and on the other side to another collar, sub, or one end of a casing conduit member.

Typical of such prior art patents disclosing various valving structures for flotation and cementing operations include U.S. Pat. No. 1,776,613, to Baker, which discloses a well shoe for floating a casing into place. The float shoe which is shown has a downwardly opening check valve which is cemented in place by the cement or concrete plug at the end of the shoe. Additionally, U.S. Pat. No. 1,994,846, to Baker, also discloses a float shoe having a plug closure at the end which closes the opening through the shoe while the casing is being floated into place. The plug may thereafter be forced out to permit the cementing of the well. Additionally, U.S. Pat. No. 4,442,894, to Callihan et al, discloses a cementing float valve and wiping plug combination wherein the valve structure is indirectly secured to the valve housing, which is metallic, by means of cement.

Subsequent to a cementing operation, it often is desirable to drill through the cement shoe or collar. For such purpose, a drill bit is run in on a drill string within the casing and rotated at high rpm to drill through such valve structures within the float equipment. Accordingly, it has been found that valve head and seat arrangements and other components of the valving structures in float equipment which are fabricated using metallic components are highly disadvantageous to speedy and economical drilling operations for drilling up such valve collars and shoes, and, in combination with the cementitious material which is utilized in such devices, makes the drill up operation extremely time consuming, in many instances.

While there are recognized advantages in using cementitious material to secure the valve structure to the interior of the metallic housing for such float shoes and collars, the space afforded for such cementitious material greatly reduces the fluid flow area within the valve structure. Additionally, even the best and highest quality cementitious material has a tendency to be comparatively highly porous, thus providing which is sometimes referred to in the industry as a "microannulus" area through the cementitious material which prevents the valving structure from affording a positive and complete seal to completely eliminate fluid flow through and across the device.

In prior art float valve structures used in collars and shoes there is provided a biasing means to urge the valve head to its companion valve seat in the closed position, such biasing means typically being a compressible spring, or the like. Such spring elements will be of a metallic substance which are housed within such prior art valving structures such that they are generally always exposed to and in contact with the corrosive fluids in the well. Additionally, the high velocity, cementitious and other fluids which are pumped through the valving structure have, in prior art devices, come into contact with such biasing spring members to subject them to errosion, thus greatly reducing their life expectancy and performance integrity.

Still another problem encountered in prior art designs of such valving structures in float equipment for subterranean wells is the inability of such devices to fully shift the valve head away from the valve seat when cementitious fluids are pumped through the casing string at reduced flow rates, on the order of about 2 to 3 barrels per minute, thus resulting in the valve head of the device being within the flow path of the fluid such that the turbulence of the fluid causes valve throttling, resulting in abrasion and errosion of the head structure and a reduction of the fluid sealing integrity between the head and seat arrangement.

The present invention provides a device which overcomes the above-described problems encountered in prior art structures.

SUMMARY OF THE INVENTION

The present invention is directed to a subterranean well casing float tool, either in the form of a float shoe or float collar. The tool has a tubular metal housing which is secured to the well casing conduit thereabove. Valving means are placed within the housing and comprise the thermosetting frame and valve head and valve seat means which are operatively carried relative to the frame and selectively movable relative to one another from an open position to a closed position. Biasing means, such a spring, are provided for relatively urging said valve head toward the valve seat. A compartment including the valve head is provided for enclosure around the biasing means when the valve head is moved fully away from the valve seat means. Means are provided for directly securing the valving means to the housing, thus eliminating the need for cementitious material for securment of the valving means to the housing.

Additionally, the tool may also comprise an elastomeric means received around the exterior of the valving means for sealing engagement between the valving means and the tubular metal housing for prevention of a micro-annulus between the valving means and the housing.

DESCRIPTION OF THE PREFERRED EMBODIMENTS

Figure 1:
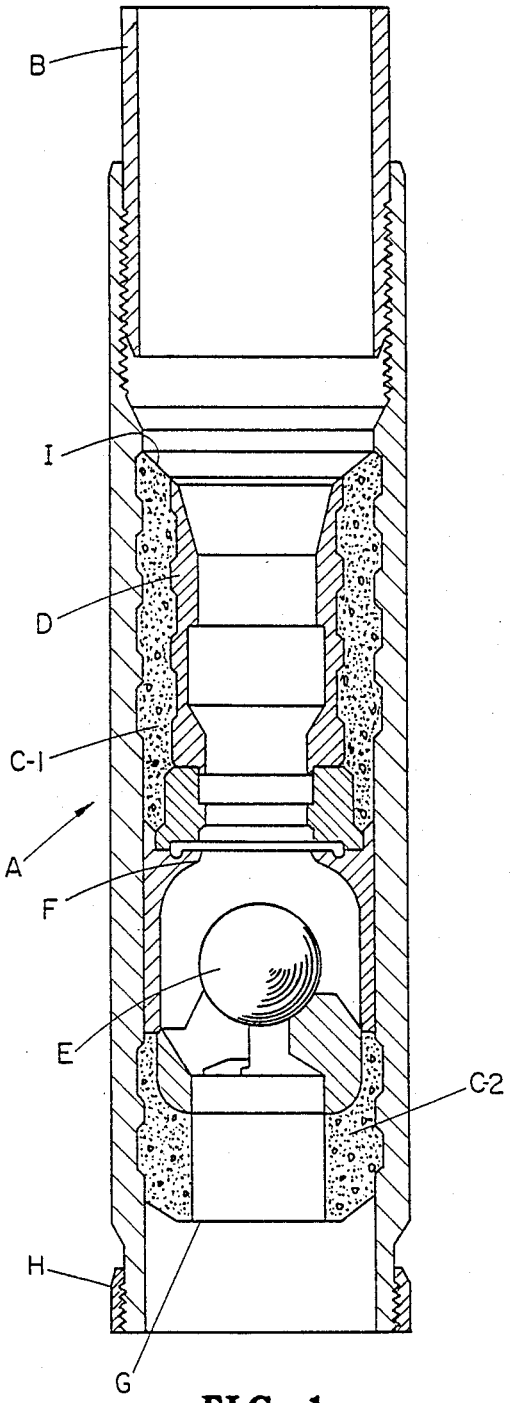
FIG. 1 (PRIOR ART)
FIG. 1 is a longitudinal sectional illustration of a device of the prior art.

With reference to FIG. 1, there is shown a typical prior art float valve device A which is threadably secured onto a casing conduit member B thereabove and a conduit member H therebelow, such device A thus being what is commonly referred to as a float collar. The device A has a valve member D secured therein by means of a cementitious material implaced between the interior of the housing H and the valve member D at cementitious solidifications C1 and C2. A ball valve head E selectively moves relative to a seat F to control fluid flow through the apparatus A to permit fluid to pass interiorly of the device through the lower end G and subsequently through the casing conduit member H and therebelow. An uppermost beveled profiled seat I will receive a companionly profiled outer surface of a cementitious wiping plug (not shown) which is introduced into the casing conduit at an interval or stage or at the completion of the cementing operation for the subterranean well.

Figure 2:
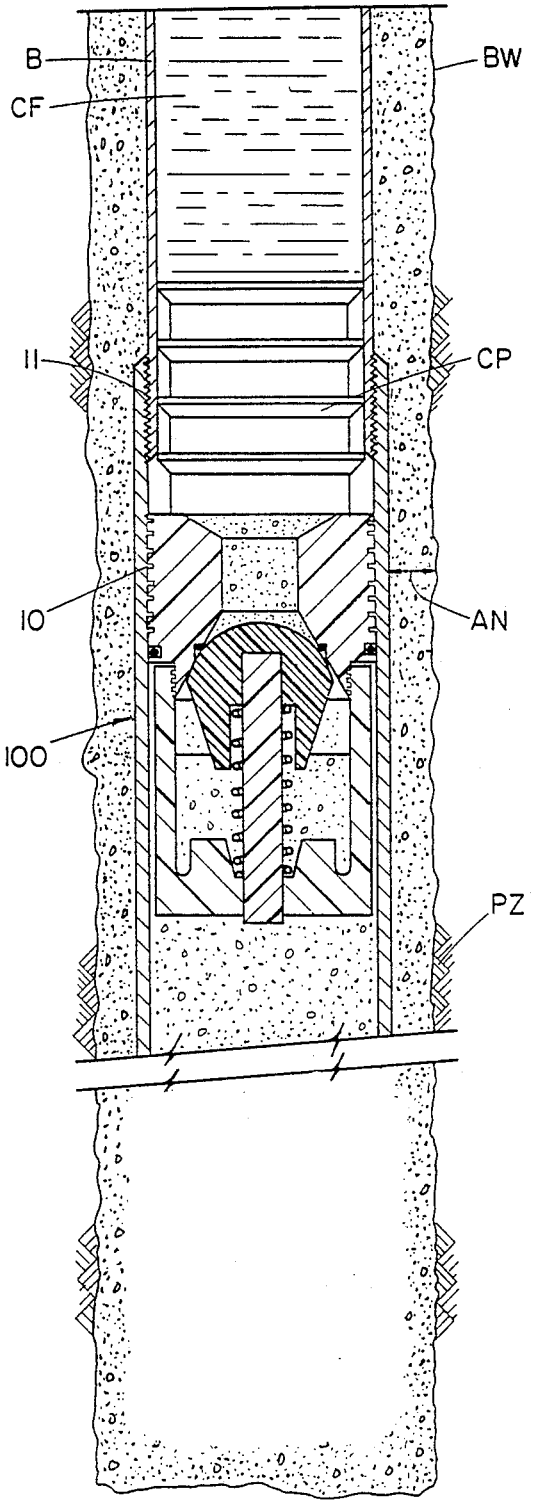
FIG. 2 is a elongated half sectional view of the tool of the present invention carried by a casing conduit and in position subsequent to a cementing operation.

Now referring to FIG. 2, there is shown in longitudinal cross-sectional perspective the apparatus 100 of the present invention implaced within a subterranean well W and carried into the well W by means of a casing string having casing member B immediately above the apparatus 100 and is secured to the member B at threads 11. The casing string B with the apparatus 100 thereon is run into the well subsequent to the drilling operation for flotation of the casing for positioning laterally of a production zone PZ within the wellbore wall BW.

The view in FIG. 2 is of the apparatus 100 with its valving structure 100 in the closed position having received a cement plug CP thereabove subsequent to the cementing operation, with cementitious fluid CF previously being introduced through the casing member B for passage through the apparatus 100, thence upwardly through to the annulus AN between the outer housing 10 of the apparatus 100 for deposition between the wellbore wall BW and the casing conduit string C.

As shown in FIG. 2, the apparatus 100 is provided in the form of a float collar. However, as discussed above, the apparatus 100 may also be provided in the form of a casing collar member, i.e., at the lowermost end of the casing string.

Figure 3:
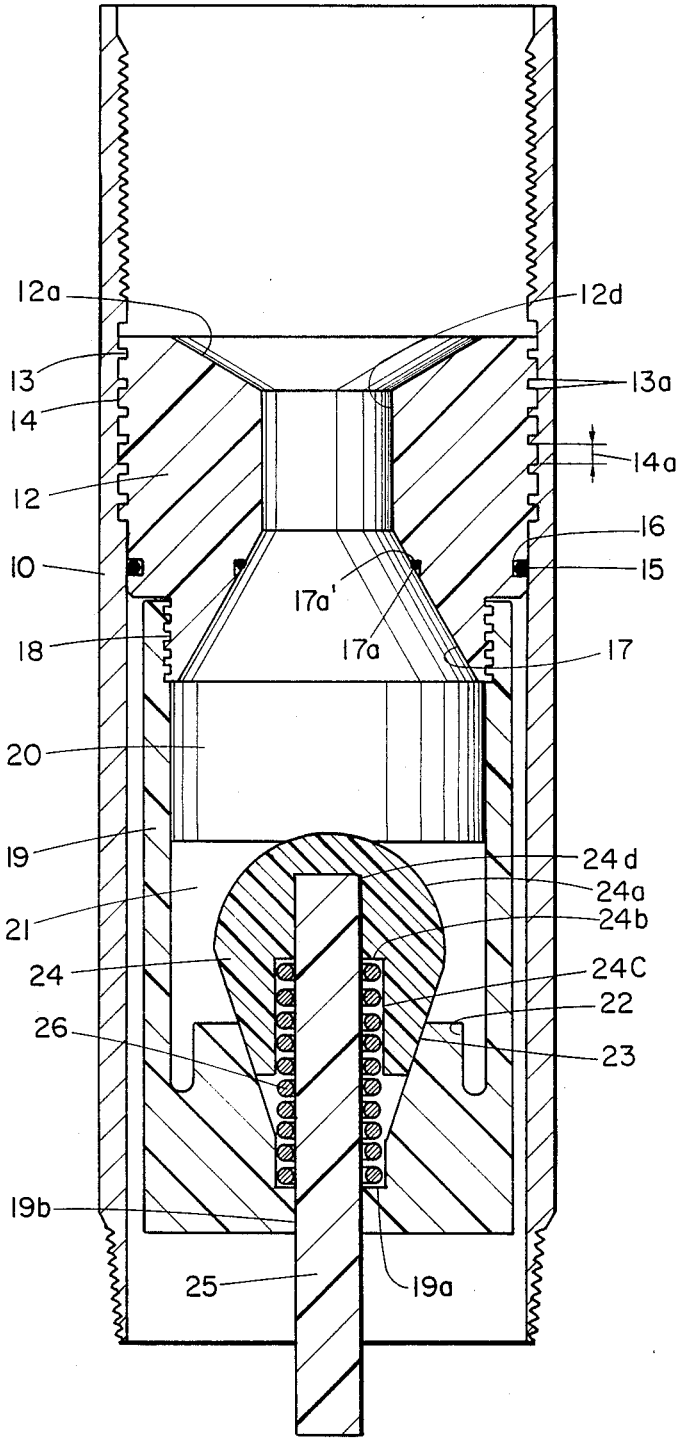
FIG. 3 is an enlarged sectional view of the tool of the present invention with the valve head in the fully open position and the biasing means compartmentalized.

Now, with reference to FIG. 3, the apparatus 100 is provided in the form of a metallic outer housing 10, which may be carbon steel, or the like, having a hardness substantially greater than the internal components of the valving means, comprising the valve seat housing 12 and a frame 19 therebelow, and longitudinally dependent from the valve seat housing 12 and secured thereto at threads 18. Of course, seat housing 12 and frame 19 can be one integral component, eliminating the need for securement by threads 18, or the like.

The valve seat housing 12 has at its uppermost end a circumferentially extending seat surface **12*a* for receipt of the cement plug CP thereon to prevent further downward travel of the cement plug CP during the cementing operation. The valve seat housing 12 also has therethrough a fluid passage 12*d* communicating with the interior of the casing member B and casing string thereabove and the interior of the casing, or well, at the bottom of the apparatus 100 through which cement or other fluids may flow downwardly, during flotation of the casing string to position in the well, or during the cementing operation, or the like. The valve seat housing 12, as well as other internal components of the apparatus 100 are provided in the form of a thermosetting material, described below. Accordingly, it is anticipated that the shear strength of these components will be substantially less than the shear strength of the harder carbon steel, or the like, utilized in the manufacture of the outer housing 10. Accordingly, valve seat housing 12 is provided with elongated male thread profiles 14, which preferably may have a length of approximately 4 times that of companion male thread members 13 provided on and extending inwardly from outer housing 10 toward valve seat housing 12. Accordingly, thread members 13 are provided with thread shear length 13*a* which, as set forth above, is substantially less than thread shear length 14*a* on threads 14. The imbalance between the lengths 13*a* and 14*a* provide increased shear strength through the thermosetting material of the valve seat housing 12 such that shear strength is enhanced with respect to the shear strength of the threads 13 of the outer housing 10**.

The configuration and length of the thread shear lengths **13*a*, 14*a* relative to one another optimizes the strength of the thermosetting material in the valve seat housing 12 such that there is increased shear area within the valve seat housing 12 in contrast to the area provided in the outer housing 10**.

It should also be noted that the apparatus 100 is directly secured to the outer housing 10 by means of the threads 13, 14 extending between the valve seat housing 12 and the outer housing 10, and that the valve seat housing 12 is not secured within the outer housing 10 by means of any cementitious or other materials. This direct securement of the valve seat housing 12 relative to the valving means, i.e., housing 12, in addition to the provision of a circumferentially extending elastomeric seal means 15 implaced within a groove 16 on the lowermost end of the valve seat housing 12 and below the threads 13 and 14, assures a fluid tight seal between the outer housing 10 and the valve seat housing 12 and the elimination of any micro-annulus for fluid creepage between the members 10, 12.

The valve seat housing 12 of the apparatus 100 carries at its lowermost end by means of threads 18 a cylindrically shaped elongated frame member 19, also provided in the form of a thermosetting material. The frame 19 provides through its approximate upper half a solid circumferentially extending solid shroud member 20 which assists in keeping fluid turbulence away from a valve head 24. A flow passage 21 is provided below the shroud 20 and fluidly communicates with the fluid passage **12*b* thereabove and the interior of the well therebelow, such that when the valve head 24 is away from sealing engagement with the valve seat housing 12, fluid will pass through the passage 12, thence downwardly within the apparatus 100 and outwardly thereof through the flow passage 21 and around the exterior of the valve head 24**.

When the valve head 24 is in its closed position relative to the valve seat housing 12, as shown in FIG. 2, an outer, upwardly facing seal surface **24*a* will smoothingly engage the secondary seal surface 17 companionly profiled on the valve seat housing 12. In addition, to provide a primary seal between the valve seat housing 12 and the valve head 24, a primary seal 17*a* is provided in the form of an elastomer ring received within a groove $17a^1$ within the valve seat housing 12**.

The valve head 24 is securely affixed around the uppermost end of a longitudinally extending shaft member 25, also made of a thermosetting material the same as or substantially the same as the valve seat housing 12 the frame 19, and the valve head 24, and is received within a hollow threaded shaft receptacle **24*d* within the interior of the valve head 24. Around that portion of the shaft 25 protruding outwardly of the shaft receptacle 24*d* is a circumferentially extending biasing member, or spring 26, the uppermost end of which rests upon a spring cage top portion 24*b* in the head 24. The lowermost end of the compressed biasing member, or spring 26, is snuggingly secured on a spring seat 19*a* in the frame 19**.

The shaft 25 also extends through a bore **19*b* extending through the lowermost end of the frame 19, and the shaft 25 will move longitudinally therethrough as the valve head 24 is moved between its open and closed positions relative to the valve seat housing 12**.

Below the shaft receptacle **24*d* and within the poppet head 24 is provided a bored spring cage 24*c* which receives the upper portion of the compressed biasing member or spring 26 which is positioned around the exterior of the shaft 25. Thus, when the poppet head 24 is shifted to its lowermost position, as shown in FIG. 3, the poppet head 24 exterior will no-go upon a shoulder 23 of a circumferentially extending valve head doughnut configuration 22 of the frame 19. The interengagement of the poppet head 24 relative to the valve head doughnut 22 in combination with the positioning of the shaft 25 relative to the spring 26 will provide a fluid flow resistant chamber or compartment for the spring 26, such that errosive effects of high turbulence of fluid flow through the apparatus 100 will be resisted and reduced, thus enhancing the life expectancy of the spring 26, which normally will be of metallic construction. Additionally, particulate matter which may be within the cementitious fluid passing through the fluid passage 12*b* and the flow passage 21 as a contaminate of such fluid will not come into contact with the spring 26 during fluid flow to interfere with the action of the spring 26 over the lifetime of the apparatus 100. Accordingly, cementitious material will pass inwardly within the passages 12*d*, 21 within the apparatus 100 and completely around the poppet head 24 when the poppet head 24 is in its fully open position relative to the valve seat housing 12**.

It should be noted that the construction of the apparatus 100 enables the poppet head 24 to move to its completely open position by overcoming the resistance to downward movement afforded by the action of the spring 26 at very low flow rates, on the order of about two (42 gallon-per) barrel per minute flow rates. Accordingly, upon activation of cement fluid flow, the poppet head 24 is moved quickly away from the valve seat housing 12 to minimize damage to the poppet head 24, to increase effective sealing integrity during the lifetime of the apparatus 100 between the seals 16, 17 on the valve seat housing 12 and the seal surface **24*a* of the poppet head 24, but effectively away from the seal surface 24*a* of the head 24. This is effected by the creation of a high pressure drop across the poppet head 24 without inducing significant errosion by the creation of a high velocity area below the shroud 20 and within the flow passage 21 exterior of the poppet head 24. Accordingly, the velocity of the fluid passing through the passage 12*d*, 21, will occur in a non-critical area, as opposed to immediate the poppet head 24 interface with the valve seat housing 12. In other words, the highest velocity of the fluid will occur subsequent to movement of the poppet head 24** to its fully open position.

It is anticipated that all of the components of the apparatus 100, except the outer housing 10 and biasing means, or spring 26, will be manufactured of a thermosetting material which, after exposure to well temperatures on the order of about 400° F. will have no visual damage and no substantial alteration of physical properties. The use of the thermosetting material thus enables ready and efficient drilling through of the apparatus 100 by polycrystalline diamond compact drill bits.

Those skilled in the art of thermoset plastic materials and phenolic molding procedures will be able to select a particular phenolic thermosetting plastic for use in the manufacture of the valving means, i.e., valve seat housing 12, frame 19, poppet head 24, and the like, incorporated in the apparatus 100. Such materials may be utilized to provide the apparatus by compression, transfer or screw injection molding techniques. When compression and transfer molding techniques are utilized, preforming pressure can be about 1200 psi; preheat temperature and time (rf) can be about 230° F. at about 30 seconds; the mold temperature can be about 325° F.; the mold pressure compression can be about 2500 psi; the mold pressure at transfer can be about 4000 psi; and the cure time ($\frac{1}{8}$ in.) can be about 40 seconds. When utilizing screw injection molding techniques, the barrel temperature can be about 140° F. at the rear, about 170° F. at the middle; and about 190° F. at the nozzle; the plastication rpm can be about 50; the back pressure can be about 25 psi; the material temperature can be about 235° F.; the injection pressure can be about 8000 psi; the injection time can be about 5 seconds; the hold pressure can be about 4000 psi; the hold time can be about 10 seconds; the mold temperature can be about 330° F.; and the cure time ($\frac{1}{8}$ in.) can be about 35 seconds.

The selected phenolic material which is utilized to make the thermosetting components for use in the present invention should have the following material, mechanical and thermal properties:

| PROPERTY | ASTM Method | Units (US) Value |
|---|---|---|
| Specific Gravity | D-792-A | 1.90 |
| Flexural Strength | D-790 | 22,000 psi |
| Flexural Modulus | D-790 | $2.9 \times 10^6$ psi |
| Tensile Strength | D-638 | 10,500 psi |
| Compressive Strength | D-695 | 35,000 psi |
| Deflection Temperature | D-648-A | 530° F., |

In the preparation of the thermosetting material utilized to make the valving means of the apparatus 100, phenolic 1-step resins with glass fiber reinforcement can be utilized. One step phenolic resins are well known to those skilled in the plastics molding and fabrication arts. As an example of one type of thermosetting phenolic molding material which can be utilized to make the thermosetting component parts of the present invention, one may select the phenolic material marketed and manufactured by Rogers Corporation, Manchester, Conn., under the trademark RX-647.

OPERATION

Now, with reference to FIGS. 2 and 3, after the casing string contained the casing member B and the apparatus 100 thereon are run into the well, such that the lowermost end of the casing string is immediate the production zone PZ, a cementitious material CF is pumped within the interior of the casing member B for passage through the passage 12*b* of the valve seat housing 12. Since the poppet head 24 has been held against the valve seat housing 12 by means of the sealing engagement of the seal surface 24*a* of the poppet head 24 along the sealing surface 17 of the housing 12 with the elastomeric seal 15 positioned for sealing engagement around the poppet head 24, it is necessary to shift the poppet head 24 to the open position by overcoming the upward, closing bias exerted against the lowermost end of the poppet head 24 by means of the spring 26 which has expanded from its compressed configuration. When the flow rate of the cementitious material approaches approximately 2 barrels per minute, or the like, the fluid flow velocity will increase below the shroud 20 within the flow passage 21 and the poppet head 24 will move completely downwardly, such that the poppet head seat surface 24*b* will no-go upon the profiled shoulder 23 within the interior of the valve head doughnut 22. The spring 26 will compress and be housed within the doughnut 22 and the interior of the valve 24.

Upon completion of the cementing operation, fluid velocity will be decreased such that the compression of the spring 26 during the opened position of the valve head 24 will urge the poppet head 24 upwardly with its shaft 25 to sealing engagement on the valve seat housing 12.

In the event that it becomes necessary to drill out the apparatus 100, a drill string to the end of which is affixed a diamond or other hard-surfaced bit, will be positioned within the casing string and casing member C. Because the components of the apparatus 100 other than the outer housing 10 and spring 26, are not metallic, or contain, only minute metallic, components and are, in fact, made of a thermosetting material, such components are easily drilled through by the drill bit.

Since a cementitious material is not implaced within the interior of the outer housing 10 for securement of the valve seat housing 12 and frame 19 to the outer housing 10, it will be appreciated that the valve seat housing 12 is directly secured to the outer housing 10 at the threads 13, 14. The shear length 14*a* of the male thread members 14 on the valve seat housing 12 will provide a greater shear length and greater shear strength than those afforded by the length 13 of the threads 13 companionly extending outwardly of the outer housing 10.

It should further be appreciated that the apparatus 100 has its valve system which is spring biased. Therefore, the apparatus 100 also has unique utility as a float valve for use in horizontal completion techniques.

Although the invention has been described in terms of specified embodiments which are set forth in detail, it should be understood that this is by illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed and desired to be secured by Letters Patent is:

1. A subterranean well casing float tool, comprising:
(a) a tubular metal housing securable to a well casing conduit;
(b) valving means implaced within said housing, said valving means comprising:
(1) a thermosetting frame;
(2) valve head and valve seat means operatively carried relative to said frame and selectively movable relative to one another from an open position to a closed position;
(3) biasing means for relatively urging said valve head toward said valve seat means;
(4) a compartment including said valve head for enclosure around the biasing means when the valve head is moved fully away from the valve seat means; and
(c) means for directly securing said valving means to said housing.

2. The tool of claim 1 further comprising an elastomeric means received around the exterior of said valving means for sealing engagement between said valving means and said tubular metal housing for prevention of a micro-annulus between said valving means and said housing.

3. The tool of claim 1 wherein said valve head and valve seat means are thermosetting.

4. The tool of claim 1 further comprising an elastomer seal juxtapositioned interiorly relative to said valve seat means for sealing engagement with said valve head when said valve head is moved relative to said seat means to the closed position.

5. The tool of claim 1 further comprising primary and secondary seal means between said valve head and valve seat means to prevent fluid flow across said valve head and valve seat means when said head and seat means are moved relative to one another to the closed position, said primary seal means comprising an elastomeric seal received within said valve seat means and said secondary seal means comprising a portion of the exterior surface of said valve head means and a companionly profiled surface on said valve seat means.

6. The tool of claim 1 further comprising an elongated thermosetting stem member secured to said valve head means for receipt of said biasing means exteriorly therearound.

7. The tool of claim 1 wherein the compartment comprises a doughnut configuration at one end of and on said frame.

8. The tool of claim 1 further comprising fluid flow restriction means intermediate and adjacent to said valve head means and said frame whereby fluid material pumped through said casing float tool at a minimum flow rate of about 2 barrels per minute will overcome the bias of said biasing means to move said valve head relative to said valve seat means to the fully open position.

9. The tool of claim 1 wherein said means for directly securing said valving means with said housing comprises thread members on said housing and said valving means, the thread members on said valving means having outwardly extending male elements for receipt within companion female elements of said thread members on said housing, said housing having thread members having male elements extending outwardly away from said housing and into female elements of said thread members of said valving means, the male elements of said thread members of said valving means having a shear area larger than the shear area of said male elements of said thread members of said housing.

10. A well casing float shoe, comprising:

(a) a tubular metal housing securable to a wel casing conduit;

(b) thermosetting valving means implaced within said housing, said valving means comprising:

(1) a frame;

(2) valve head and valve seat means operatively carried relative to said frame and selectively movable relative to one another from an open position to a closed position;

(3) means for directly securing said valving means to said housing; and (4) means for relatively urging said valve head toward said valve seat means.

11. The well casing float tool of claim 10 wherein the means for relatively urging said valve head toward said valve seat means is a biasing means.

* * * * *